US006891179B2

(12) United States Patent
Batten et al.

(10) Patent No.: US 6,891,179 B2
(45) Date of Patent: May 10, 2005

(54) IRON ORE COMPOSITE MATERIAL AND METHOD FOR MANUFACTURING RADIATION SHIELDING ENCLOSURE

(75) Inventors: Patrick A Batten, Ft Collins, CO (US); James P Wester, Loveland, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/280,863

(22) Filed: Oct. 25, 2002

(65) Prior Publication Data

US 2004/0081286 A1 Apr. 29, 2004

(51) Int. Cl.[7] ..... G21F 1/00
(52) U.S. Cl. ..... 250/515.1; 250/505.1
(58) Field of Search ..... 250/505.1, 506.1, 250/515.1, 517.1

(56) References Cited

U.S. PATENT DOCUMENTS 4,437,013 A * 3/1984 Hondorp ..... 250/515.1
4,569,818 A * 2/1986 Popp et al. ..... 376/272
5,113,425 A * 5/1992 Zweig ..... 378/190
6,048,379 A 4/2000 Bray et al.
6,166,390 A 12/2000 Quapp et al.
6,310,355 B1 10/2001 Cadwalader
6,352,363 B1 * 3/2002 Munger et al. ..... 378/203
6,372,157 B1 4/2002 Krill et al.
6,485,176 B1 * 11/2002 Chen et al. ..... 378/193

FOREIGN PATENT DOCUMENTS

JP 406347424 A * 12/1994 ..... G01N/23/00

* cited by examiner

*Primary Examiner*—Nikita Wells
*Assistant Examiner*—Christopher M. Kalivoda
(74) *Attorney, Agent, or Firm*—Cynthia S. Mitchell

(57) ABSTRACT

Materials and methods of manufacturing radiation shielded enclosures is presented that may replace the use of lead, granite and other heavy, expensive, toxic, environmentally unfriendly or otherwise undesirable materials and manufacturing methods. The present invention provides a high-density radiation shielding enclosure manufactured by cold casting a liquid refined iron ore or taconite composite material into a mold of an enclosure of an appropriate shape and size to house an x-ray imaging system. The method of manufacture may include applying an iron ore or tungsten composite caulking compound to the radiation shielding enclosure in order to seal any radiation leaks in the radiation shielding enclosure.

15 Claims, 3 Drawing Sheets

IRON ORE COMPOSITE MATERIAL AND METHOD FOR MANUFACTURING RADIATION SHIELDING ENCLOSURE

FIELD OF THE INVENTION

The present invention pertains generally to the field of radiation shielding, and more particularly to materials and methods of manufacturing radiation shielding enclosures.

BACKGROUND OF THE INVENTION

There are numerous uses for an x-ray shielding container, such as medical x-ray machines and industrial vision inspection machines. For example, x-ray detection is used to image dense objects, such as human bones, that are located within the body. Another application of x-ray detection and imaging is in the field of non-destructive electronic device testing. For example, x-ray imaging is used to determine the quality of solder that is used to connect electronic devices and modules to printed circuit boards.

X-ray imaging works by passing electromagnetic energy at wavelengths of approximately 0.1 to $100\times10^{-10}$ meters (m) through the target that is to be imaged. The x-rays are received by a receiver element, known as an x-ray detector, on which a shadow mask that corresponds to the objects within the target is impressed. Dark shadows correspond to dense regions in the target and light shadows correspond to less dense regions in the target. In this manner, dense objects, such as solder, which contains heavy metals such as lead, can be visually distinguished from less dense regions. This allows the solder joints to be inspected easily.

X-ray radiation is dangerous to living beings and the environment. Therefore, x-ray equipment is typically contained within an x-ray shielding container.

The shielding containers in x-ray applications have typically been built from welded steel frames with plates of lead or sheets of granite attached for shielding. Plate lead shielding is very expensive and the sheets of lead are difficult to attach to an enclosure to form a shielded enclosure. A lead enclosure typically requires steel or other exterior enclosure to protect the lead shielding from damage. Lead is also a highly toxic material, making its use in medical, industrial and commercial settings undesirable. It is also very difficult to seal holes, cracks, joints, seams and other leak points in a lead enclosure.

Although granite is not a toxic material, granite-shielding enclosures suffer many of the same shortcomings as lead shielding enclosures. Granite is also very heavy and difficult to manufacture and work with. As most radiation leakage will occur around seams, joints or holes, granite must be worked with in large sheets for large medical and industrial enclosures. This makes working with and transporting a granite enclosure very difficult due to the weight of the enclosure. Moreover, granite composites typically have poor radiation shielding characteristics.

Accordingly, there exists a need for an environmentally safe, low cost, radiation shielding enclosure with good radiation shielding properties. In particular, a need exists for a radiation shielding enclosure made of a shielding material other than lead or granite.

SUMMARY OF THE INVENTION

An apparatus for enclosing and shielding x-ray imaging and inspection equipment using a taconite or iron ore composite rather than lead or granite is provided. The radiation shielding enclosure may be manufactured with a casting or injection molding process in an epoxy, polyester, or polymer substrate with or without a fiberglass or other fabric material to reinforce the form of the enclosure.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
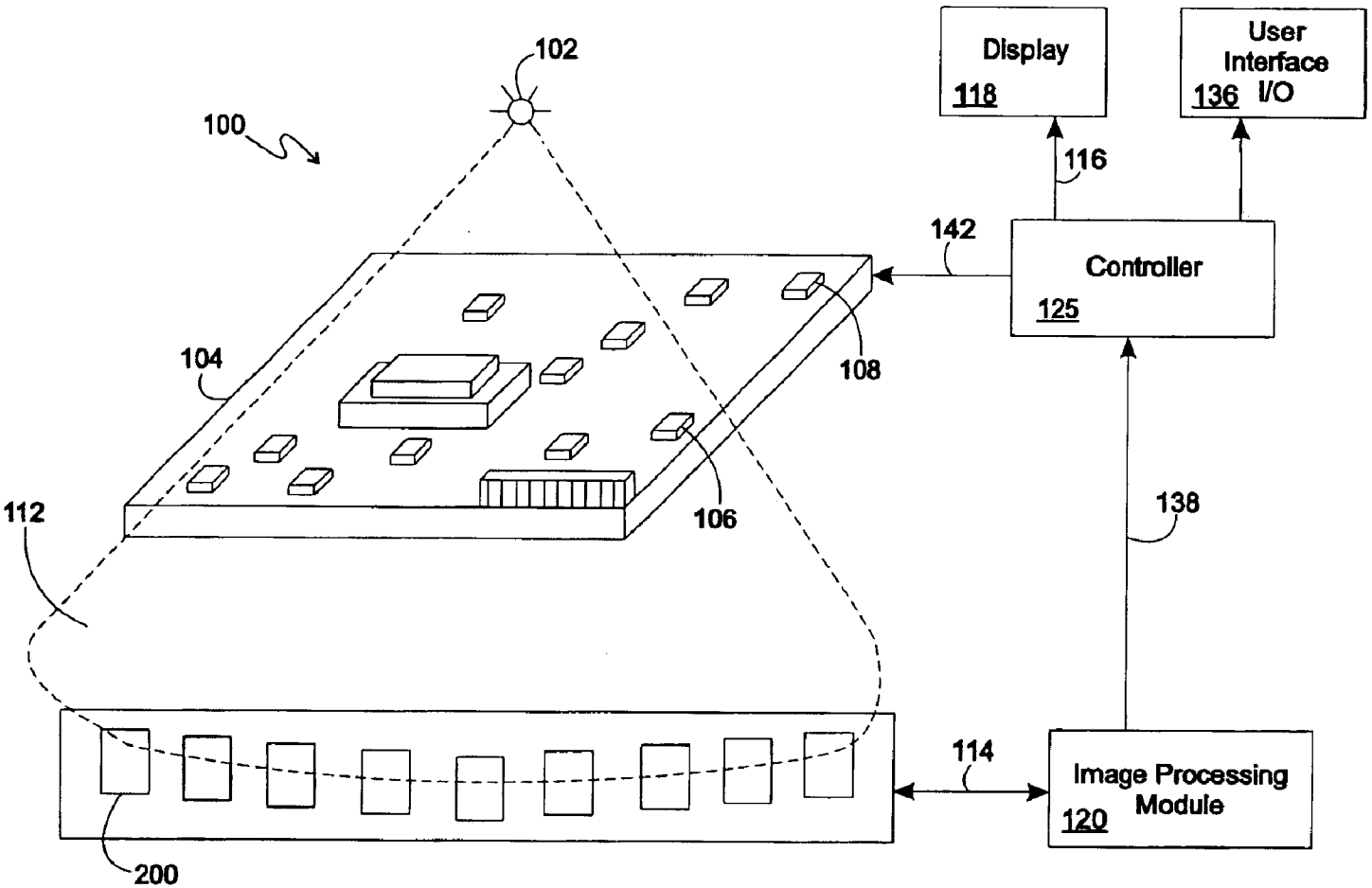
FIG. 1 Prior Art
FIG. 1 is a schematic diagram illustrating an exemplary x-ray imaging system.

As shown in the drawings for purposes of illustration, the present invention relates to techniques for providing a radiation shielding enclosure. While described below with particular reference to an x-ray imaging system and with particular illustration of an x-ray imaging system for inspecting solder on printed circuit boards (PCB), embodiments of the invention are applicable in other x-ray systems.

Turning now to the drawings, FIG. 1 illustrates an exemplary x-ray imaging system 100 in which an x-ray detector 200 resides. The x-ray imaging system 100 includes an x-ray source 102 and a plurality of x-ray detector assemblies, an exemplary one of which is illustrated using reference numeral 200. A plurality of x-ray detectors 200 is typically supported on an x-ray detector assembly fixture (hereinafter detector fixture) 110.

The x-ray detectors 200 and the detector fixture 110 are coupled to an image-processing module 120 via connection 114. The image-processing module 120 is coupled to a controller 125 via connection 138. Each image-processing module 120 may receive input from one or more x-ray detectors, depending on the desired processing architecture.

A controller 125 is coupled to the image-processing module 120 via local interface 138. The local interface 138 may be, for example, but not limited to, one or more buses or other wired or wireless connections, as known to those having ordinary skill in the art. The local interface 138 may have additional elements, which are omitted for simplicity, such as buffers (caches), drivers, and controllers, to enable communications.

The user interface 136 may be any known or developed I/O or user interface, such as, for example, a keyboard, a mouse, a stylus or any other device for inputting information into the controller 125.

The controller 125 may be coupled to a display 118 via connection 116. The display 118 receives the output of the controller 125 and displays the results of the x-ray analysis.

In operation, the x-ray imaging system 100 can be used, for example, to analyze the quality of solder joints formed when components are soldered to a printed circuit board (PCB). For example, a PCB 104 includes a plurality of components, exemplary ones of which are illustrated using reference numerals 106 and 108. The components 106 and 108 are generally coupled to the PCB 104 via solder joints. The x-ray imaging system 100 can be used to inspect and determine the quality of the solder joints. Although omitted for. simplicity, the PCB 104 may be mounted on a movable fixture (not shown) that is controlled by the controller 125 via connection 142 to position the PCB 104 as desired for x-ray analysis.

The x-ray source 102 produces x-rays generally in the form of an x-ray radiation pattern 112. The x-ray radiation pattern 112 passes through portions of the PCB 104 and impinges on an array of x-ray detectors 200. As the x-rays pass through the PCB 104, areas of high density (such as solder) appear as dark shadows on the x-ray detectors 200, while areas of less density (such as the material from which the PCB is fabricated), appear as lighter shadows. This forms a shadow mask on each x-ray detector 200 corresponding to the density of the structure through which the x-rays have passed. Although omitted for simplicity, the controller 125 also controls the x-ray source.

As will be described in further detail below, each x-ray detector 200 is constructed and located within the x-ray imaging system 100 so as to receive the x-ray energy from the x-ray source 102 after it passes through the PCB 104 or other target to be analyzed, examined, inspected or radiated, such as flesh, humans, animals, food, etc. The x-ray detector 200 converts the x-ray energy to an electrical image signal that is representative of the shadow mask that falls on the x-ray detector 200. The electrical image signals from all of the x-ray detectors 200 are sent to the controller 125. The image-processing module processes the signals, which can then be provided as an output to the display 118.

It will be appreciated that the present x-ray imaging system 100 is provided in high level merely for purposes of example of such a system. Other system configurations and architecture are fully anticipated, as well as other targets 104 for analyzing, examination, inspection and radiation, such as flesh, humans, animals, food, etc.

Generally, it is desirable to contain the x-rays within an enclosure. This is because x-rays tend to degrade certain electronic devices and are hazardous to living creatures and the environment.

Figure 2:
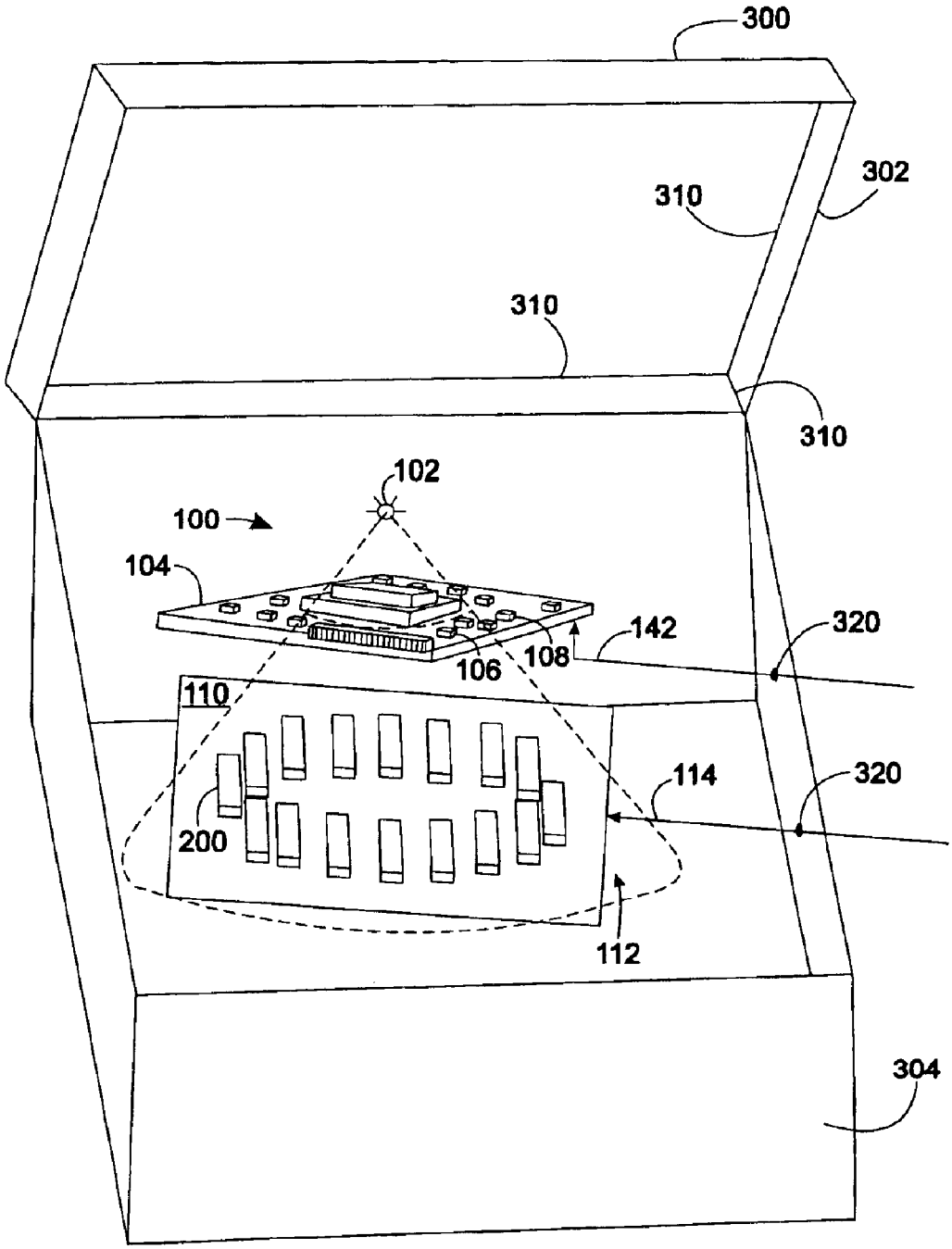
FIG. 2 illustrates a radiation shielding enclosure in accordance with the invention.

FIG. 2 shows a radiation shielding enclosure 300 of an iron ore composite material with main body 304 and lid 302. Radiation shielding enclosure 300 may have joints 310, sealed with an iron ore composite compound and input/output holes 320, sealed with an iron ore composite compound. FIG. 2 shows an x-ray imaging system 100, such as an x-ray imaging printed circuit inspection system. X-ray imaging system 100 is shown merely for example purposes. Other industrial, manufacturing, and medical radiation emitting systems may be enclosed and shielded with the iron ore composite radiation shielding enclosure 300 of the present invention. During use, the iron ore composite radiation shielding enclosure 300 shields the x-rays from exposure outside of the enclosure 300.

Figure 3:
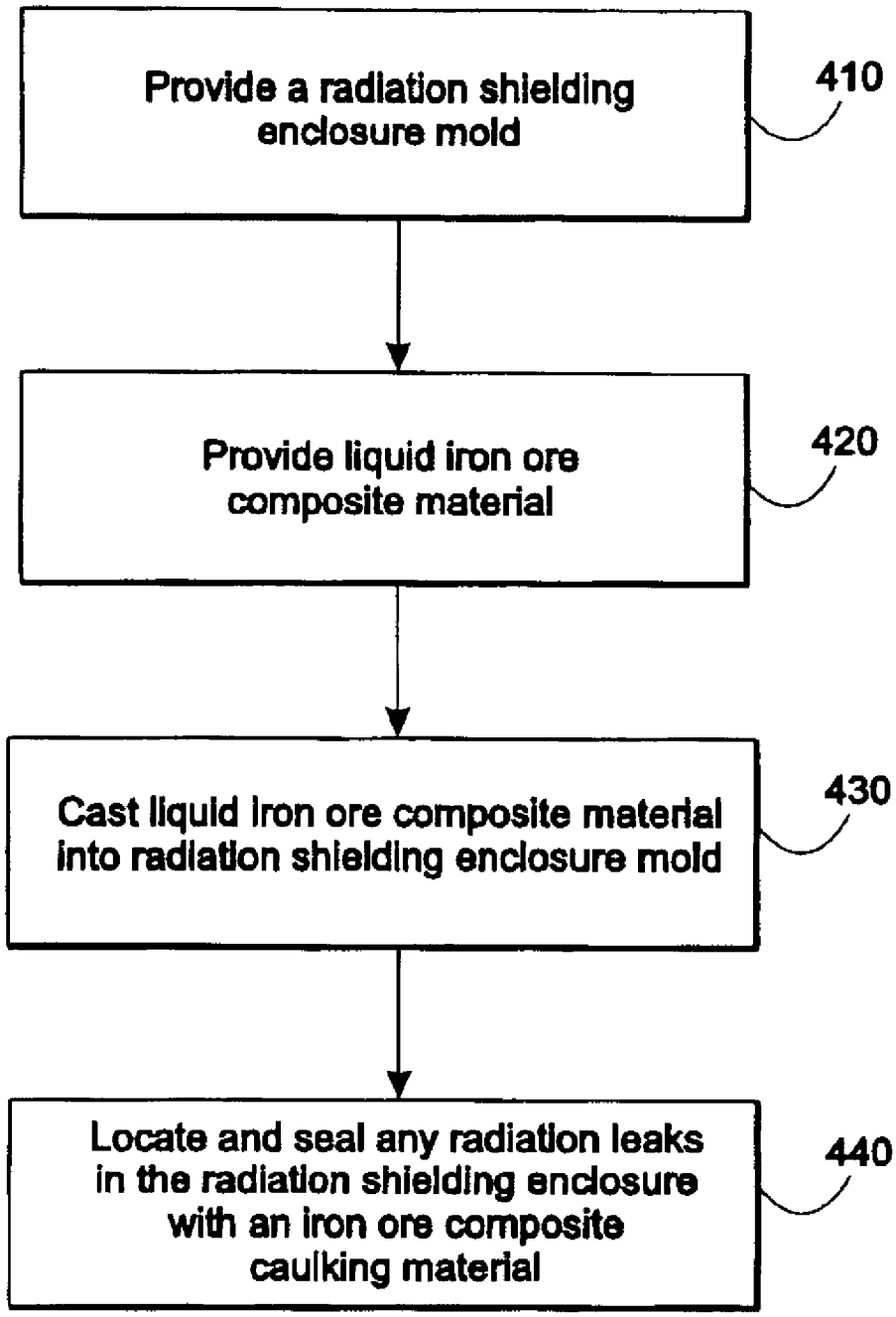
FIG. 3 illustrates a flow chart of a process for forming a radiation shielding enclosure in accordance with one embodiment of the invention.

FIG. 3 shows a flow chart for a manufacturing process according to the present invention. An enclosure mold is provided 410. The enclosure mold may be any shape or size that is capable of functioning as an enclosure for an x-ray imaging system 100. A liquid iron ore composite material is provided 420. The liquid iron ore compound may contain refined iron ore, taconite, filler material and any known epoxy binder substrate. The iron ore composite material is preferably 90 percent or more iron ore. The liquid iron ore is poured or cast into the enclosure mold 430 to form the radiation shielding enclosure 300 by a cold casting process. Any radiation leaks in the radiation shielding enclosure 300 are located and filled with an iron ore composite caulking material 440. The iron ore composite caulking material may contain iron ore filler material and any known caulking or sealant material. The iron ore composite caulking/sealant material is preferably 90 percent or more iron ore.

Although this preferred embodiment of the present invention has been disclosed for illustrative purposes, those skilled in the art will appreciate that various modifications, additions and substitutions are possible, without departing from the scope and spirit of the invention, resulting in equivalent embodiments that remain within the scope of the appended claims. For example, the iron ore composite material or caulking compound may also contain tungsten or other dense metals.

What is claimed is:

1. A system, comprising:

an x-ray imaging system, wherein said x-ray imaging system comprises a source for imaging a target and a detector for detecting an imaged target; and a cast iron ore composite radiation shielding enclosure, wherein said cast iron ore composite radiation shielding enclosures substantially encloses said x-ray imaging system; wherein said cast iron ore composite radiation shielding enclosure is configured to open and close for insertion and removal of a target to be imaged; wherein said cast iron ore composite radiation shielding enclosure is configured to receive input data and power to said x-ray imaging system from a source external to said cast iron ore composite radiation shielding enclosure while said cast iron ore composite radiation shielding enclosure is in a closed position; wherein said cast iron ore composite radiation shielding enclosure is configured to output data from said x-ray imaging system to an output device external to the cast iron ore composite radiation shielding enclosure while said cast iron ore composite radiation shielding enclosure is in a closed position; wherein said cast iron ore composite radiation shielding enclosure is configured to substantially shield x-ray emissions while said x-ray imaging system receives and outputs power and data to one or more points external to said cast iron ore composite radiation shielding enclosure while said x-ray imaging system operates.

2. A system manufactured in accordance with claim 1, wherein said cast iron ore composite material comprises approximately 90 percent iron ore.

3. A system manufactured in accordance with claim 2, wherein said cast iron ore composite material comprises an epoxy substrate material.

4. A system manufactured in accordance with claim 2, wherein any input/output data or power line holes or other leaks in said radiation shielding enclosure are sealed with a liquid iron ore composite caulking compound.

5. A system comprising:

an x-ray imaging system, wherein said x-ray imaging system comprises a source for imaging a target and a detector for detecting an imaged target; and an iron ore composite radiation shielding enclosure, wherein said iron ore composite, radiation shielding enclosure houses said x-ray imaging system; wherein said iron ore composite radiation shielding enclosure is configured to substantially shield x-ray emissions while said x-ray imaging system receives and outputs power and data to one or more points external to said iron ore composite radiation shielding enclosure while said x-ray imaging system operates.

6. The system according to claim 5, wherein said iron ore composite radiation shielding enclosure is made of cast iron.

7. The system according to claim 5, wherein said iron ore composite material comprises 90 percent or more iron ore.

8. The system according to claim 5, wherein any input/output data or power line holes or other radiation leaks in said iron ore composite radiation shielding enclosure is sealed with an iron ore composite caulking compound.

9. A system manufactured in accordance with claim 1, wherein said x-ray imaging system is an x-ray inspection machine.

10. A system manufactured in accordance with claim 1, wherein said x-ray imaging system is a medical x-ray machine.

11. A method for manufacturing a radiation shielding enclosure comprising the following steps:

i. providing a mold of an enclosure;

ii. pouring a liquid iron ore composite material into said mold to form a radiation shielding enclosure of cast iron ore composite material;

iii. configuring said radiation shielding enclosure to open and close for insertion and removal of an x-ray imaging target; and iv. providing holes in said radiation shielding enclosure for input/output data and power lines.

12. The method for manufacturing a radiation shielding enclosure in accordance with claim 11, wherein said liquid iron ore composite material contains 90 percent or more iron ore.

13. The method for manufacturing a radiation shielding enclosure in accordance with claim 11 further comprising a step of sealing any input/output data or power line holes or other radiation leaks in said radiation shielding enclosure by means of an iron ore composite caulking compound.

14. The method of manufacturing a radiation shielding enclosure in accordance with claim 13, wherein said iron ore composite caulking compound comprises 90 percent or more iron ore.

15. The method of manufacturing a radiation shielding enclosure in accordance with claim 14, wherein said iron ore composite caulking compound comprises epoxy, polyester substrate, caulk, or adhesive.

* * * * *

UNITED STATES PATENT AND TRADEMARK OFFICE

CERTIFICATE OF CORRECTION

PATENT NO. : 6,891,179 B2
APPLICATION NO. : 10/280863
DATED : May 10, 2005
INVENTOR(S) : Batten et al.

It is certified that error appears in the above-identified patent and that said Letters Patent is hereby corrected as shown below:

On the face page, in field (75), under "Inventors", in column 1, line 2, delete "Loveland," and insert -- Valley Oak Drive, --, therefor.

In column 4, line 60, in Claim 5, after "composite" delete ",".

Signed and Sealed this

Twenty-eighth Day of November, 2006

JON W. DUDAS
*Director of the United States Patent and Trademark Office*